United States Patent [19]

Muller

[11] Patent Number: 4,738,715

[45] Date of Patent: Apr. 19, 1988

[54] DESULFURIZING REAGENT FOR HOT METAL

[75] Inventor: Albert Muller, Lebanon, N.J.

[73] Assignee: Hart Metals, Inc., Tamaqua, Pa.

[21] Appl. No.: 106

[22] Filed: Jan. 2, 1987

[51] Int. Cl.[4] ..... C21C 7/02

[52] U.S. Cl. ..... 75/58; 75/53

[58] Field of Search ..... 75/53, 58

[56] References Cited

U.S. PATENT DOCUMENTS 3,929,464 12/1975 Todd ..... 75/53

3,998,625 12/1976 Koros ..... 75/53

4,401,465 8/1983 Neelameggham ..... 75/53

4,431,444 2/1984 Hammer ..... 75/53

*Primary Examiner*—Peter D. Rosenberg

*Attorney, Agent, or Firm*—Ronald G. Goebel

[57] ABSTRACT

The invention provides an injectable powdered reagent for the desulfurization of hot metal, such as iron external to the blast furnace. The reagent includes a slag-forming component comprising burnt lime, metallurgical fluorspar, and petroleum coke. Magnesium powder is combined with the slag-forming component to form a powdered reagent which is injected into the hot metal.

16 Claims, No Drawings

DESULFURIZING REAGENT FOR HOT METAL

BACKGROUND OF THE INVENTION

This invention is concerned with a reagent composition and process for desulfurizing blast furnace hot metal external to the furnace itself which provides efficient removal of sulfur from liquid hot metal together with reduced costs for this operation.

The demand for low sulfur liquid iron to be charged to steel refining furnaces continues to increase as requirements for stronger, tougher steels with good formability, weldability and better surface quality expands worldwide. In general, sulfur is an undesirable impurity in high quality steels except in cases where it is intentionally added to improve machinability.

In the past, a number of reagents have been developed and employed for desulfurizing hot metal external to the blast furnace in both torpedo cars and transfer ladles. These may be classified into the following three general categories: (1) sulfur removal by metals; (2) sulfur removal by compounds; and (3) sulfur removal by slags. All of these classes of materials and the manner in which the operations have been conducted have both technical and economic limitations. As yet there is no preferred method of external desulfurization which is universally accepted or practiced. Desulfurization is a complex process that is affected by many interrelated technical factors.

In order to appreciate better the process of sulfur removal from blast furnace hot metal, it is first necessary to consider the effect of some of the elements normally present in the hot metal such as carbon, silicon, phosphorous, aluminum, etc., on the activity coefficient of sulfur in liquid iron. All of these elements increase the activity coeffiecient of sulfur in iron. Carbon and silicon, both of which are present in significant quantities in hot metal increase the activity coefficient of sulfur appreciably. For normal hot metal containing 4.2% C and 1.5% Si, the activity coefficient is about 5. This means that the sulfur activity in this hot metal is five times greater than that expected from the actual sulfur concentration in the metal. Because of this, sulfur removal is much easier from hot metal than from steel which contains less carbon and silicon. Thus, it is logical to assume that if additional carbon is added to a desulfurizing slag reagent, it should make sulfur removal more effective.

With regard to the first method, desulfurization by metals, the ability of a given metal to remove sulfur can be predicted from the free energy of formation of its sulfide together with a knowledge of its solubility in liquid iron. Sodium, potassium, calcium, strontium and barium all have high negative free energies of formation of their sulfides making them good candidates for desulfurization. However, all of these metals have minimal or no solubility in liquid iron. This leaves only two metals, magnesium and rare earths with the required high-negative free energy of sulfide formation plus the required solubility in iron available for hot metal desulfurization. The rare earth metals desulfurize effectively, but a large quantity is required to remove a given weight of sulfur because of their high atomic weight. This plus their much higher cost rules out their use for iron treatment.

With regard to the second method, desulfurization with compounds such as lime, soda ash, calcium carbide, calcium cyanamide, etc. depends upon finding a compound with a free energy of formation of its sulfide which is more negative than the free energy of formation of the compound itself. In the case of burnt lime, CaO, for example, as a desulfurizing agent the free energy of formation of CaO is more negative than the free energy of formation of CaS, and desulfurization cannot proceed unless the oxygen released in the reaction is continuously removed by reaction with carbon, silicon, aluminum or other deoxidizing elements.

With all of the above in mind, optimum desulfurization can be expected to occur only when the thermochemical factors mentioned above are properly combined with the physical conditions employed for desulfurization. For best results the following conditions must be met:

1. The reagent must be thoroughly mixed with the liquid iron from which sulfur is to be removed. The best way of achieving this is by powder injection and/or vigorous stirring.
2. The oxygen potential of the slag/metal system must be low (low FeO and MnO).
3. The reaction products produced must be removed from the system. This requirement emphasizes the necessity of using adequate amounts of fluid basic slags which have good sulfide holding capacity to sequester the sulfide reaction products.
4. There must be effective contact of the slag/metal interface to minimize the time required to remove the sulfide reaction products.
5. Since oxygen forms more stable compounds with the metals, compounds and slag forming materials than sulfur, every attempt must be made to exclude oxygen from the system to avoid reversion of the sulfur from the slag to the metal. This includes oxygen resulting from erosion of the ladle lining as well as oxygen from the reaction, the atmosphere and any oxides present.

It can be seen from these considerations that the development of an efficient reagent for desulfurizing hot metal involves much more than the obvious simple mixing of several materials already known to be able to desulfurize. The reagent composition of this invention combines the desulfurizing action of materials in a manner such that the final result provides a unique material and method of application capable of performing in a manner not achieved by simply adding the individual effects of the materials involved.

SUMMARY OF THE INVENTION

The present invention provides a slag forming, desulfurizing reagent composition in finely-divided form which is injected into hot metal, such as iron, external to the blast furnace as for example, in a transfer ladle. The reagent comprises a slag forming mixture of burnt lime (CaO), metallurigcal fluorspar ($CaF_2$), and a carbonaceous material such as petroleum coke (C) into which mixture is blended magnesium powder (Mg).

The powdered reagent is injected into the hot iron metal using dry nitrogen carrier gas through a standard refractory coated injection lance to form a high sulfide capacity slag which can be easily separated from the treated iron.

Alternatively, the magnesium metal may be coinjected with the slag-forming mixture using a twin tank co-injection system.

DETAILED DESCRIPTION OF THE PREFERRED EMBODIMENTS

The slag-forming component of the reagent comprises a mixture of finely-divided burnt lime, metallurgical fluorspar and petroleum coke. The burnt lime, CaO, should comprise from 85% to 95% by weight of the mixture and preferably about 90% by weight. The particle size of the burnt lime should be from −150 mesh to 325 mesh, and preferably about −200 mesh. The metallurgical fluorspar, $CaF_2$ should comprise from about 2% to 8% by weight of the mixture and preferably about 5% by weight and should have a particle size between −25 mesh and 75 mesh, preferably about 50 mesh. The carbonaceous material should comprise from about 2% to 8% by weight of the mixture and preferably about 5% by weight and should have a particle size between −25 mesh and 75 mesh, preferably about 50 mesh. The carbonaceous material may include petroleum coke, by-product coke, pitch carbon coke and graphite. Petroleum coke is preferred, however. The metallic Mg powder blended with the slag-forming component should comprise from 10% to 15% of the total weight of the component and preferably about 12.5% by weight of the component.

The present reagent composition increases the effectiveness of the lime contained therein, i.e. making it more "active", thereby reducing the amount of more expensive magnesium powder that would normally be required to desulfurize the liquid iron. Making the lime more "active" involves two factors. The first is the addition of carbon in the form of petroleum coke to increase the activity of sulfur in the molten iron. This increased activity beyond the normal sulfur activity (which is proportional to its concentration in the melt) is significant to the removeal of sulfur. Both aluminum and ferrosilicon also can be used to increase sulfur activity, but carbon is the preferred agent since it gives the greatest activity increase. The carbon is not present to reduce the violence of magnesium treatement as has been stressed in the prior art. It should be noted, however, that some reduction in violence will result from the fact that significantly less magnesium will be needed per ton of metal treated because the active lime will perform more of the desulfurization. The second factor involves the carbon addition which relates to the thermodynamics of the lime reaction in desulfurizing. The free energy of formation of calcium oxide is more negative than that for calcium sulfide. Because of this, desulfurization by lime cannot proceed unless the oxygen formed in the reaction is continually removed by carbon or some other deoxidizing material. Thus, there are two reasons for adding carbon to the reagent mix, neither of which involves attempts to reduce the violence normally experienced when magnesium is brought into contact with molten iron.

The fluorspar in the reagent produces a fluid, highly basic slag with low oxygen potential and high sulfide-holding capacity. When this slag is present in sufficient quantity to retain the sulfur transferred from the liquid iron to the slag phase, it minimises reversion of the sulfur from the slag to the metal. Sulfur removal from the metal occurs by the combined action of the lime and the magnesium powder.

The metallic magnesium which dissolves in the iron desulfurizes by forming magnesium sulfide which is retained in the slag. In addition the combination of some Mg vapor bubbles and the nitrogen bubbles formed from the injection transport gas intensively stirs the molten metal which promotes the transfer of the sulfide reaction products to the slag and generally improves the surface contact between the metal and slag phases.

In general 3 or 4 lbs. of reagent composition is required per ton of hot metal treated to effect desulfurization.

The reagent is prepared by first forming a mixture of the slag-forming component and then adding thereto the magnesium powder by blending. To aid flow control 0.1% by weight of a silicone fluid such as polydimethyl siloxane may also be added. The powdered reagent is then injected into the hot iron metal external to the blast furnace using a dry inert gas such as nitrogen through a standard refractory coated injection lance at a rate of 60–120 lbs. per minute at a fluid density of 3 to 10 lbs. of reagent powder per standard cubic foot of nitrogen gas. Variations in the operating parameters will be necessary to accomdate different sizes of ladles and depths of injection. Alternatively, the slag forming componet can be placed in one tank of a twin tank co-injection system and the magnesium powder placed in the other tank. The slag-forming component and magnesium powder are then co-injected using a dry gas such as nitrogen into the hot iron metal as indicated above.

Although the reagent composition is particularly useful for desulfurizing hot iron metal external to the blast furnace, it may also be used to desulfurize other hot metals such as cupola metal.

What is claimed is:

1. A finely-divided reagent composition for the desulfurization of hot metal from a blast furnace cupola, or electric furnace by injection into sadi metal comprising a mixture of:

(a) a slag-forming component including;
  (1) burnt lime;
  (2) metallurgical fluorspar; and
  (3) a carbonaceous material selected from the group consisting of petroleum coke, by-product coke, pitch carbon coke and graphite; and
(b) magnesium powder.

2. The reagent composition of claim 1 wherein said burnt lime comprises from about 85% to 95% by weight of said slag-forming component.

3. The reagent composition of claim 1 wherein said metallurgical fluorspar comprises from abut 2% to 8% by weight of said slag-forming component.

4. The reagent composition of claim 1 wherein said carbonaceous material comprises from about 2% to 8% by weight of said slag forming component.

5. The reagent component of claim 1 wherein said magnesium powder comprise from about 10% to 15% of the total weight of said slag-forming component.

6. A finely-divided reagent composition (for the desulfurization of hot iron metal from a blast furnace by injection into said metal) comprising a mixture of:

(a) a slag-forming component including:
  (1W1) from about 85% to 95% of burnt lime;
  (2) from about 2% to 8% of metallurgical fluorspar; and
  (3) from about 2% to 8% of petroleum coke; and
(b) from 10% to 15% of magnesium by total weight of said slag-forming component.

7. The composition of claim 6 wherein said burnt lime comprises about 90% by weight of said slag-forming component.

8. The composition of claim 6 wherein said metallurgical fluorspar comprises about 5% by weight of said slag-forming component.

9. The composition of claim 6 wherein said petroleum coke comprises about 5% by weight of said slag-forming component.

10. The composition of claim 6 wherein said magnesium comprises about 12.5% of the total weight of said slag-forming component.

11. The composition of claim 6 wherein the particle size of said burnt lime is from −150 mesh to 325 mesh.

12. The composition of claim 6 wherein the particle size of said fluorspar and said petroleum coke is each from −25 mesh to 75 mesh.

13. A finely-divided reagent composition (for the desulfurization of hot iron metal from a blast furnace by injection) comprises a desulfurizing composition including:

(a) a slag-forming component including:

(1) about 90% by weight of burnt lime having a particle size of between −150 mesh and 325 mesh;

(2) about 5% be weight of metallurgical fluorspar having a particle size of between −25 mesh and 75 mesh; and (3) about 5% by weight of petroleum coke having a particle size of betwen −25 mesh and 75 mesh; and (b) about 12.5% of powdered magnesium by total weight of said slag-forming component.

14. The reagent composition of claim 13 wherein the particle size of the burnt lime is −200 mesh.

15. The reagent composition of claim 13 wherein the particle size of the metallurgical fluorspar is −50 mesh.

16. The reagent of claim 13 wherein the particle size of the petroleum coke is −50 mesh.

* * * * *